US005507883A

United States Patent [19]

Tanaka et al.

[11] Patent Number: 5,507,883

[45] Date of Patent: Apr. 16, 1996

[54] GRAIN ORIENTED ELETRICAL STEEL SHEET HAVING HIGH MAGNETIC FLUX DENSITY AND ULTRA LOW IRON LOSS AND PROCESS FOR PRODUCTION THE SAME

[75] Inventors: Osamu Tanaka; Hiroaki Masui; Hotaka Honma; Katsuro Kuroki; Tsutomu Haratani; Yoichi Mishima; Maremizu Ishibashi; Yoshio Nakamura, all of Kitakyushu, Japan

[73] Assignee: Nippon Steel Corporation, Tokyo, Japan

[21] Appl. No.: 257,765

[22] Filed: Jun. 9, 1994

Related U.S. Application Data

[63] Continuation of Ser. No. 85,511, Jun. 30, 1993, abandoned.

[30] Foreign Application Priority Data

| | | | |
|---|---|---|---|
| Jun. 26, 1992 | [JP] | Japan | 4-169714 |
| Jul. 2, 1992 | [JP] | Japan | 4-175790 |
| Aug. 3, 1992 | [JP] | Japan | 4-206795 |
| Aug. 19, 1992 | [JP] | Japan | 4-220500 |
| Oct. 22, 1992 | [JP] | Japan | 4-284787 |
| Nov. 12, 1992 | [JP] | Japan | 4-302728 |
| Dec. 21, 1992 | [JP] | Japan | 4-340746 |

[51] Int. Cl.[6] ..... H01F 1/04

[52] U.S. Cl. ..... 148/113; 148/111

[58] Field of Search ..... 148/111, 113

[56] References Cited

U.S. PATENT DOCUMENTS

| | | | |
|---|---|---|---|
| 3,265,600 | 8/1966 | Carter et al. | 148/113 |
| 3,671,337 | 6/1972 | Ko Kumai et al. | 148/111 |
| 3,785,882 | 1/1974 | Jackson | 148/113 |
| 3,856,568 | 12/1974 | Tanaka et al. | 117/70 B |
| 3,932,236 | 1/1976 | Wada et al. | 148/113 |
| 4,032,366 | 6/1977 | Choby, Jr. | 148/31.5 |
| 4,344,802 | 8/1982 | Haselkorn | 148/27 |
| 4,367,100 | 1/1983 | Miller, Jr. | 148/113 |
| 4,443,425 | 4/1984 | Sopp et al. | 423/635 |
| 4,543,134 | 9/1985 | Tanaka et al. | 148/113 |

FOREIGN PATENT DOCUMENTS

| | | |
|---|---|---|
| 0305966 | 3/1989 | European Pat. Off. . |
| 0392534 | 10/1990 | European Pat. Off. . |

(List continued on next page.)

OTHER PUBLICATIONS

Data Base WPI, Section Ch, Week 7815, Derwent Publications Ltd., Class M27, AN-78-27745A, Abstract of JP-A-53-022113, Mar 1, 1978.

Patent Abstract of Japan, vol. 8, No. 212 (C-244) Sep. 27, 1984.

Patent Abstracts of Japan, vol. 3, No. 142(C-65) Nov. 24, 1979.

European Search Report EP 93 11 0517.

*Primary Examiner*—John Sheehan

*Attorney, Agent, or Firm*—Kenyon & Kenyon

[57] ABSTRACT

A grain oriented electrical steel sheet having no significant glass film and having a high magnetic flux density and an excellent iron loss property, comprising, in terms of by weight, 2.5 to 4.5% of Si, the steel sheet having, as oxides on its surface, a glass film comprising 0.6 g/m$^2$ or less in total of forsterite and spinel composed of MgO, $SiO_2$ and $Al_2O_3$ and an insulating coating having a thickness of 6 μm or less, the face tension imparted on the surface of the steel sheet by the coating being in the range of from 0.5 to 2.0 kg/mm$^2$. In the final box annealing of the steel sheet after primary recrystallization annealing, use is made of an annealing separator comprising 100 parts by weight of MgO and, added thereto, 2 to 30 parts by weight of at least one member selected from the group consisting of chlorides, carbonates, nitrates, sulfates and sulfides of Li, K, Bi, Na, Ba, Ca, Mg, Zn, Fe, Zr, Sr, Sn, Al, etc., and the heating in the final box annealing is effected in an atmosphere comprising $N_2$ and $H_2$ with the nitrogen content being 30% or more at a heating rate of 20° C./hr or less, and a seam or spotty flaw is imparted at an angle of 45° to 90° to the rolling direction of the steel sheet.

9 Claims, 2 Drawing Sheets

U.S. PATENT DOCUMENTS

| | | | |
|---|---|---|---|
| 0420238 | 4/1991 | European Pat. Off. . | |
| 0488726 | 6/1992 | European Pat. Off. . | |
| 0525467 | 3/1993 | European Pat. Off. . | |
| 0565029 | 10/1993 | European Pat. Off. . | |
| 0566986 | 10/1993 | European Pat. Off. . | |
| 40-15644 | 7/1965 | Japan . | |
| 53-22113 | 3/1978 | Japan . | |
| 56-65983 | 6/1981 | Japan . | |
| 58-26405 | 6/1983 | Japan . | |
| 59-96278 | 6/1984 | Japan . | |
| 61-139679 | 6/1986 | Japan . | |
| 64-8362 | 1/1989 | Japan . | |
| 64-83620 | 3/1989 | Japan . | |
| 2-259017 | 10/1990 | Japan | 148/111 |
| 3-75354 | 3/1991 | Japan . | |
| 1480514 | 7/1977 | United Kingdom . | |

GRAIN ORIENTED ELETRICAL STEEL SHEET HAVING HIGH MAGNETIC FLUX DENSITY AND ULTRA LOW IRON LOSS AND PROCESS FOR PRODUCTION THE SAME

This is a continuation of application Ser. No. 08/085,511 filed on Jun. 30, 1993, now abandoned.

BACKGROUND OF THE INVENTION

1. Field of the Invention

The present invention relates to a grain oriented electrical steel sheet not having a glass film (a forsterite film) and particularly to a grain oriented electrical steel sheet having a high magnetic flux density and an ultra low iron loss and remarkably excellent workability, such as slittability, cuttability and punchability, and a process for producing the same.

2. Description of the Prior Art

Grain oriented electrical steel sheets are used mainly as an iron core material for transformers and other electrical equipment and should be excellent in magnetic properties, such as inductions and an iron loss property.

In order to obtain good magnetic properties, it is necessary to highly arrange the <001> axis which is an easily magnetizable axis in the direction of rolling. Further, sheet thickness, grain size, specific resistance, film, etc. are also important because they have a great influence on the magnetic properties.

The orientation of grains has been remarkably improved by a method characterized by a high reduction ratio in final cold rolling wherein AlN and MnS are used as an inhibitor, so that, at the present time, it has become possible to provide steel sheets having a magnetic flux density close to the theoretical value. On the other hand, film properties and workability in addition to magnetic properties are important to the use of grain oriented electrical steel sheets by customers. In general, grain oriented electrical steel sheets are treated with a film having a double layer structure comprising a glass film formed in the final box annealing and an insulating film. The glass film is composed mainly of forsterite ($Mg_2SiO_4$) that is a product of a reaction of MgO as an annealing separator with $SiO_2$ formed during decarburization annealing. This ceramic film is hard and highly resistant to abrasion and has a significant adverse effect on durability of tools used in working of electrical steel sheets, such as slitting, cutting and punching. For example, when grain oriented electrical steel sheets having a glass film are subjected to punching, there occurs abrasion of molds and the occurrence of burr in the sheet at the time of punching becomes significant after effecting the punching about several thousand times, which leads to problems of use. For this reason, it becomes necessary to effect regrinding of molds or replacement of the molds with new molds. This lowers the working efficiency in the working of iron cores by customers and incurs an increase in the cost. With respect to the magnetic properties of the electrical steel sheets, although an improvement in the iron loss can be certainly attained by virtue of the tension of the film, in some forming conditions an increase in the thickness of the film or other unfavorable phenomenon unfavorably gives rise to a lowering in the magnetic flux density due to the presence of non-magnetic substances. For this reason, in the case of thick materials wherein improvement of the iron loss by the tension of the film is expected, or in the case where the iron loss can be improved by the division of the magnetic domain using other means, grain oriented electrical steel sheets not having a glass film are desired rather than grain oriented electrical steel sheets having a glass film because of the above-described problem.

Especially, in recent years, techniques using optical, mechanical and chemical means have been developed for refinning the magnetic domain, which enables the iron loss to be improved without the tension of the glass film, and it has become apparent that the grain oriented electrical steels sheet not having a glass film are advantageous over those having a glass film by virtue of the absence of an adverse effect of an internal oxide layer of the glass film which causes a pinning phenomenon with respect to the movement of the domain wall in the magnetization. For this reason, there is an ever-increasing demand for the development of a grain oriented electrical steel sheet having a high magnetic flux density and not having a glass film which is important when various working conditions used by customers are taken into consideration.

A process for producing a grain oriented electrical steel sheet not having a glass film is disclosed, for example, in Japanese Unexamined Patent Publication (Kokai) No. 53-22113. In this process, the thickness of an oxide film is brought to 3 μm or less in the decarburization annealing, particular alumina containing 5 to 40% of a hydrous silicate mineral powder is used as an annealing separator, and final annealing is effected with this annealing separator coated on the steel sheet. According to the description of the specification, this method reduces the thickness of the oxide film, enables an easily removable glass film to be formed by virtue of the incorporation of the hydrous silicate mineral and provides a steel sheet having a metallic gloss. As a method for inhibiting the formation of a glass film by using an annealing separator, Japanese Unexamined Patent Publication (Kokai) No. 56-65983 discloses a technique wherein an annealing separator comprising aluminum hydroxide and, incorporated therein, 20 parts by weight of an additive for removing impurities and 10 parts by weight of an inhibitor is coated on a steel sheet to form a thin glass film having a thickness of 0.5 μm or less. Further, Japanese Unexamined Patent Publication (Kokai) 59-96278 proposes an annealing separator comprising $Al_2O_3$, which is less reactive with $SiO_2$, as an oxide layer formed in the decarburization annealing and MgO which has an activity lowered by sintering at a high temperature of 1,300° C. or above. According to the description of the specification, the proposed annealing separator can inhibit the formation of forsterite.

All the above-described prior art techniques are based on a low-quality grain oriented electrical steel sheet having a magnetic flux density as low as 1.88 Tesla or less usually called "orient core", and no technique for stably providing a grain oriented electrical steel sheet having a high magnetic flux density contemplated in the present invention has hitherto been developed in the art.

SUMMARY OF THE INVENTION

An object of the present invention is to provide a grain oriented electrical steel sheet having a high magnetic flux density and an ultra low iron loss, which grain oriented electrical steel sheet has excellent punchability, slittability, cuttability, etc. and substantially evenly free from a glass film, and a process for producing said steel sheet at a low cost on a commercial scale.

The most characteristic feature of the material according to the present invention resides in that the material is a grain oriented electrical steel sheet not having a glass film or having no significant glass film. This characteristic feature leads to two effects. One is that the workability, such as slittability, cuttability or punchability, is excellent. Since the glass film comprises a hard ceramic, it accelerates the abrasion of working tools and reduces the workability. The second effect is to reduce the iron loss after the refinning of the magnetic domain. The iron loss is divided into a hysteresis loss as a dc component and an eddy current loss as an ac component. The eddy current loss can be decreased by reducing the sheet thickness. In this case, however, if a glass film is present on the surface of the steel sheet, since the interface of the matrix and the glass film is not smooth, the hysteresis loss increases, so that no satisfactory effect of reducing the iron loss can be attained and, rather, the iron loss increases. The feature of the mechanism for reducing the iron loss of the material according to the present invention is that the material has no glass film and has a smooth interface.

In general, the iron losses lower domain, which with increasing $B_8$ value (i.e., magnetic flux density at a magnetizing force of 800 A/m). In the present invention, however, mere increase in the $B_8$ value does not result in a lowering of the iron loss. This is because an increase in the $B_8$ value gives rise to an increase in the width of the magnetic refitting in turn increases the abnormal eddy current loss. This effect becomes significant with an increase in the smoothness of the surface of the steel sheet. For this reason, in order to sufficiently attain the effect of reducing the iron loss in the material according to the present invention, it is necessary to enhance the $B_8$ value and, at the same time, to use a technique for decarburization the magnetic domain. The formation of grooves, flaws or the like on the surface of the steel sheet by using means, such as a laser beam, a gear wheel, a press, a ball-point pen and etching, is useful for this purpose. Further, coating of a film capable of imparting a high tension while maintaining the smoothness of the surface of the steel sheet is also useful.

In the present invention, in order to produce a grain oriented electrical steel sheet of the type described above, use is made of the following specific steps. First, the amount of an oxide layer formed on the surface of the steel sheet after final box anealing is minimized. This is because the oxide layer derived from the decarburization annealing causes the occurrence of a reaction of magnesia, as an annealing separator, to form a glass film. Second, additives including Cl compounds are added to the annealing separator. These additives have a feature that they form a glass film during final box annealing and then remove the glass film. In order to provide a steel sheet having a high $B_8$ value, in the course of final box annealing involving the progress of the secondary recrystallization, precipitates called "inhibitor", which serves to regulate the grain boundary movement in the steel sheet, should be present in a limited amount under certain specific conditions and, after the secondary recrystallization, should disappear. The complicated behavior of the inhibitor is governed by the glass film. Therefore, also in the production of the material according to the present invention, although the glass film should be present for the progress of the secondary recrystallization, it should preferably disappear after the secondary recrystallization. On the other hand, for example, Cl compounds or the like generally have a melting point below the glass film formation temperature and accelerate the formation of a glass film during final box annealing. However, when the temperature is above the glass film formation temperature, the Cl contained in the compound etches the interface of the film and the matrix and removes the glass film.

A further method for enhancing the $B_8$ value is to increase the partial pressure of nitrogen in the finish-annealing atmosphere. This is the third characteristic feature of the present invention. In order to provide a grain oriented electrical steel sheet having a high $B_8$ value, the present invention is based on the assumption that nitrides are used as the inhibitor. However, weakening of the inhibitor attributable to denitriding is the greatest problem in the step of rendering the material glassless. Although the presence of a glass film in the course of the secondary recrystallization as described above in connection with the second characteristic feature is a measure for preventing denitriding, it is necessary to maintain the partial pressure of nitrogen in the final box annealing atmosphere at a certain value or higher for the purpose of further reinforcing this effect.

DESCRIPTION OF THE PREFERRED EMBODIMENTS

Figure 1A:
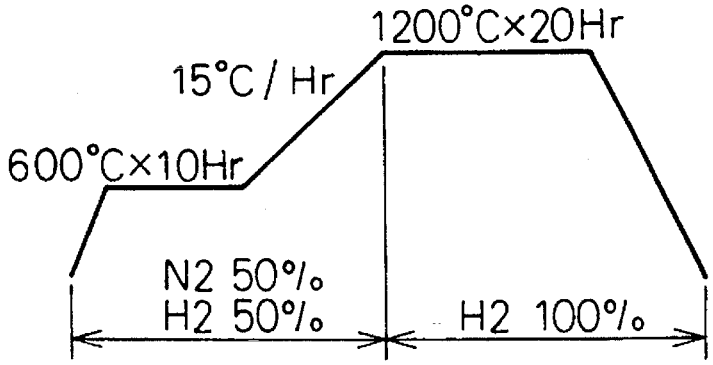
FIG. 1A is a diagram showing final box annealing conditions when the anneal atmosphere during the temperature raising portion of the annealing is 50% $N_2$ and 50% $H_2$.

Basically, in the production the grain oriented electrical steel sheet having a high magnetic flux density and an ultra-low iron loss according to the present invention, inhibitor elements, for example, Al, N, Mn and S, are not completely dissolved in the steel at the stage of heating a slab, the material is nitrided in a strong reducing atmosphere after decarburization annealing to form an inhibitor composed mainly of (Al, Si)N, and a good secondary recrystallization is developed in final box annealing, followed by the division of the magnetic domain.

The process for producing the grain oriented electrical steel sheet having a high magnetic flux density and not having a glass film according to the present invention using a starting material having the above-described composition and the above-described steps is characterized by a series of treatments conducted between decarburization annealing and final box annealing.

The material subjected to cold rolling to a final sheet thickness is subjected to decarburization annealing in a continuous line. In the decarburization annealing, C in the steel is removed, and primary recrystallization is effected. At the same time, an oxide film composed mainly of $SiO_2$ is formed on the surface of the steel sheet. In this case, the degree of oxidation of the steel sheet is the first characteristic feature of the present invention, wherein the oxygen content is 900 ppm or less, and an Fe-oxides to $SiO_2$ ratio is 0.20 or less.

The decarburization annealing is effected preferably at 800° to 830° C. in an atmosphere comprising $N_2$ and $H_2$ while controlling the dew point. Subsequently, in the second half of the decarburization annealing or after the completion of the decarburization annealing or in both the above-described stages, a nitriding treatment is effected in the same line or a separately provided line. In this case, the optimal nitrogen content is 150 ppm or more, preferably 150 to 300 ppm although it depends upon the primary recrystallized grain diameter.

Thereafter, the material is coated with an annealing separator, dried, coiled and subjected to final box annealing. In this case, the composition of the annealing separator is the second characteristic feature of the present invention and plays an important role in the formation and regulation of a glass film and the decomposition reaction of the glass film. In the annealing separator used in the present invention, MgO has a particle size distribution such that 30% or more of the MgO consists Of particles having a diameter of 10 μm or less. Further, it should have a CAA value of 50 to 300 sec and a hydrated water content of 5% or less. Further, a compound composed mainly of a Cl compound is used as an additive to the MgO. In the production of products not having a glass film, a smooth steel sheet surface and a good iron loss property, the Cl compound underlies the invention of the instant application in that it serves to remove the glass film formed during the final finish annealing. The glass film serves to regulate a nitriding reaction and a denitriding reaction during the final box annealing and to regulate the inhibitor content of the steel sheet. Therefore, mere formation of a glass film cannot provide the development of good secondary recrystallized grains, so that it is impossible to attain the iron losses reduction effect derived from a smooth steel sheet interface. For this reason, in order to provide a grain oriented electrical steel sheet having a high magnetic flux density and an ultra-low iron loss, which is the principal object of the present invention, it is necessary to form a glass film which is then removed. The Cl compound accelerates a reaction of $SiO_2$, formed on the surface of the steel sheet in the decarburization annealing, with MgO, as the annealing separator, to form a glass film at a lower temperature than that usually necessary for the formation of the glass film, and then forms a chloride of iron at the interface of the film and the matrix to remove the film. Besides the Cl compounds, S compounds, carbonates, nitrates and sulfates cause the above-described reaction, and Li, K, Bi, Na, Ba, Ca, Mg, Zn, Fe, Zr, St, Sr and Al are useful as an element combined therewith. In the process according to the present invention wherein secondary recrystallization is developed by the step of heating of a slab at a low temperature+nitriding after decarburization annealing, the Cl compound is most effective in attaining a high magnetic flux density.

With respect to the amount of addition of such a compound, when the amount is less than that specified in the claim, no satisfactory effect of removing the film can be attained, while when the amount is excessively large, the magnetic flux density falls. Thus, it becomes possible to provide a grain oriented electrical-steel sheet having no a glass film comprising forsterite and/or spinel or having no significant glass film.

Besides the annealing separator, the final box annealing conditions, as the third characteristic feature of the present invention, are important to the present invention.

Extensive experiments and studies conducted by the present inventors have revealed that annealing atmosphere conditions are an important factor for stabilizing the secondary recrystallization and increasing the magnetic flux density when, like the present invention, use is made of the step of effecting a nitriding treatment after decarburization annealing to form an inhibitor composed mainly of (Al, Si)N and regulating the formation of a glass film and causing a decomposition reaction of the glass film by using an annealing separator and final finish annealing conditions.

Specifically, when an (Al, Si)N inhibitor is utilized substantially without using a MnS as the inhibitor as in the present invention, the secondary recrystallization initiates at about 1,100° C. which is higher than that in the case of the conventional process for producing a grain oriented electrical steel sheet having a high magnetic flux density. For this reason, it is necessary to maintain the strength of the inhibitor at a constant level while effecting the inhibition of formation of the glass film and the decomposition reaction of the glass film until the temperature reaches the secondary recrystallization initiation region.

The reason for this is that, in the process where the annealing separator once initiates the formation of a glass film and then induces the decomposition reaction of the glass film, the decomposition of the inhibition in the steel rapidly proceeds from the point in time when the decomposition reaction of the glass film begins. For this reason, neither good secondary recrystallization nor high magnetic flux density can be attained without effecting finish annealing under specific conditions according to the present invention.

With respect to final box annealing conditions, in the temperature rise during which the decomposition reaction of the glass film begins, the temperature is raised in an atmosphere having a $N_2$ content of 30% or more until it reaches the soaking temperature. This enables (Al, Si)N to be stabilized until the secondary recrystallization begins. The heating rate in the final box annealing is 20° C./hr or less. When it exceeds 20° C./hr, the growth rate of secondary recrystallization becomes improper, which deteriorates the integration density in the orientation of the product, so that a satisfactorily high $B_8$ value cannot be obtained.

The steel sheet subjected to final box annealing is then subjected to baking with an insulating coating solution and heat flattening combined with shape reforming and stress relieving annealing in a continuous annealing line at 800° to 900° C. Before or after the heat flattening, a seam or spotty recess having a depth of 5 to 50 μm is imported at intervals of 2 to 15 mm in a direction at an angle of 45° to 90° to the rolling direction by a laser beam, a sprocket roll, a press, marking, local etching, etc. Thereafter, various insulating coating solution are coated according to applications on the part of the customers, and the coated material is subjected to a baking treatment. When the insulating coating solution is used for the purpose of imparting film tension, the steel sheet is coated with a coating solution comprising a phosphate or colloidal silica as described in Japanese Examined Patent Publication (Kokoku) No. 53-28375 and then subjected to a baking treatment. Further, when a good workability is needed in the use thereof on the part of the customers, the surface of the steel sheet subjected to heat flattening is coated with an organic coating solution or a semi-organic coating solution and then subjected to a baking treatment. Alternatively, the surface of the steel sheet subjected to heat flattening may be coated with an inorganic coating solution, subjected to a baking treatment and then coated with an organic coating solution and subjected to a baking treatment to form a film having a double layer structure. when use is made of the organic film forming agent, (1) at least one totally organic coating solution selected from acrylic, polyvinyl, vinyl acetate, epoxy, styrene and other resins and/or their polymers and crosslinking products, or (2) a semi-organic coating solution comprising a mixture of the resin recited in the above item (1) with at least one member selected from chromates, phosphoric acid, phosphates, boric acid, borates, etc. is coated and baked at a temperature in the range of from 150° to 450° C. to a thickness of 2 to 6 μm before use of the steel sheet.

The coating and baking treatment with these organic coating solution contributes to a remarkable improvement in the slittability, cuttability, punchability, etc. with respect to the punchability, the conventional products having a glass film can be punched about 5000 times when use is made of a steel die. On the other hand, according to the present invention, in products, wherein the thickness of the glass film is 0.3 μm or less, the punchability can be improved to about 100,000 times when an inorganic insulating coating solution agent is coated and baked, and to about 2,000,000 times when a semi-organic film forming agent is further coated and baked thereon.

The reason for the limitation of the constituent features of the present invention will now be described.

At the outset, the reason for the limitation of the chemical compositions of the electrical steel slab used as the starting material will be described.

With respect to the C content, when the content is less than 0.021%, the secondary recrystallization becomes so unstable that the magnetic flux density of the product is as low as about 1.80 Tesla in terms of the $B_8$ value even in the case of successful secondary recrystallization. On the other hand, when the C content exceeds 0.075%, the decarburization annealing time should be prolonged, so that the productivity is lowered.

With respect to the Si content, the specific resistance of the product varies depending upon the Si content. When the Si content is less than 2.5%, satisfactory iron loss value is not obtained. On the other hand, when it exceeds 4.5%, cracking and breaking of the material frequently occur during cold rolling, which makes it impossible to stably effect the cold rolling operation.

One of the characteristic features of the composition system of the starting material according to the present invention is to limit the S content to 0.014% or less. In the prior art, for example, in a technique disclosed in Japanese Examined Patent Publication (Kokoku) No. 47-25220, S (sulfur) is described as an element for forming as MnS a precipitate necessary for inducing secondary recrystallization, and there exists a content range capable of exhibiting the best effect, which content range has been specified as an amount range capable of dissolving, in a solid solution form, MnS at the stage of heating the slab prior to the hot rolling. As a result of studies in recent years, it has been found that S aggrarate the poor secondary recrystallization when a slab of a material having a high Si content is heated at a low temperature and hot-rolled in a process for producing a unidirectionally grain oriented electrical steel sheet where (Al, Si)N is used as a precipitate necessary for secondary recrystallization. When the Si content of the material is 4.5% or less, if the S content is 0.014% or less, preferably 0.0070% or less, poor secondary recrystallization does not occur at all.

In the present invention, use is made of (Al, Si)N as a precipitate necessary for the secondary recrystallization. In order to ensure the necessary minimum Al N, it is necessary for the acid-soluble Al content and M content to be 0.010% or more and 0.0030% or more, respectively. However, when the acid-soluble Al content exceeds 0.040%, the AlN content during hot rolling become improper, which renders the secondary recrystallization unstable. For this reason, the acid-soluble Al content is limited to 0.010 to 0.040%. On the other hand, when the N content exceeds 0.0130%, not only there occurs surface cracking called "blister" on the surface of the steel sheet but also the primary recrystallized grain diameter cannot be regulated. For this reason, the N content is limited to 0.0030 to 0.0130%.

When the Mn content is less than 0.05%, the secondary recrystallization becomes unstable. However, when it is excessively high, although the $B_8$ value becomes high, the use of Mn in an amount exceeding a certain value is disadvantageous from the viewpoint of cost. For this reason, the Mn content is limited to 0.05 to 0.45%.

The decarburization annealing according to the present invention preferably satisfies requirements that the oxygen content should be 900 ppm or less and the Fe-oxides to $SiO_2$ ratio is 0.20 or less. When the oxygen content exceeds 900 ppm, the $SiO_2$ and Fe-oxides contents inevitably increase and the thickness of the oxide film as well becomes large, which is disadvantageous for the glass film decomposition reaction in the final box annealing. Specifically, $SiO_2$ remains just under the surface, which weakens the effect of improving the workability or makes it impossible to bring the surface to a completely specular glassless state. Further, this is causative of the deterioration of the magnetic properties. Moreover, since the formation of excessive $SiO_2$ accelerates the decomposition of AlN etc. as the inhibitor in the steel by the action of $SiO_2$ prior to the initiation of the secondary recrystallization, there occurs a problem that a good orientation cannot be attained. However, when the degree of oxidation is extremely limited, the decarburization time should be prolonged, so that the productivity is lowered. The degree of oxidation is preferably in the range of from 400 to 700 ppm in terms of the oxygen content.

When the P content is 0.045% or less in the production of a steel by a melt process, the effect of enhancing the magnetic flux density is small. On the other hand, when the P content exceeds 0.20%, the sheets becomes so fragile that it becomes difficult to effect cold rolling.

The P content of the product is important to the present invention. P is dissolved in a solid solution form in iron, and part thereof is present in a precipitated state. The P is very useful for reducing the iron loss of the product, and in order to attain the effect, it is necessary for the P content to be 0.03% at the lowest. On the other hand, the P content exceeds 0.15%, the product becomes fragile, which is detrimental to the workability of the product, for example, punchability, so that the product is generally unsuitable for use.

The Fe-oxides to $SiO_2$ ratio in the oxide film is limited to 0.20 or less. When this ratio exceeds 0.20, since the glass film formation reaction is remarkably accelerated in the first half of the finish annealing, the amount of formation of the forsterite is increased, which inhibits the reaction in the subsequent step of decomposing the forsterite from sufficiently proceeding. When the FeO to $SiO_2$ ratio is 0.20 or less, it is possible to provide a steel sheet having substantially no glass film after the completion of the finish annealing by virtue of effects attained, for example, by the addition of additives to MgO.

The nitrogen content of the steel sheet after the completion of the decarburization annealing is generally limited to 150 ppm or more. This requirement should be satisfied for the purpose of forming the inhibitor (Al, Si)N necessary for stably providing good secondary recrystallized grains in the process of the present invention. When the nitrogen content is less than 150 ppm, the secondary recrystallization becomes so unstable that fine grains are liable to occur. On the other hand, when the nitrogen content exceeds 300 ppm, roughness and unevenness occurs in the surface of the steel sheet in subsequent reactions, such as a denitriding reaction, or such a high nitrogen content often becomes disadvantageous in the step of purification after that. For this reason, it is desirable for the nitrogen content to be 300 ppm or less.

In MgO used in the annealing separator, there is a preferable limitation on the particle diameter, CAA value and hydration ig-loss.

In the technique according to the present invention, the material is rendered glassless by decomposing and removing, through a chemical reaction, a moderate glass film formed in the first half of the temperature rise in the final box annealing. Specifically, in order to stabilize the inhibitor until the initiation of the secondary recrystallization in the first half of the final box annealing, it is necessary to utilize at this period the effect of preventing the additional oxidation, nitriding, etc. by a suitable amount of a glass film, and this is important to provide a glassless product having excellent magnetic properties.

For this purpose, it is important for the MgO as the main component of the annealing separator, as such, to have a suitable reactivity. Specifically, when the reactivity of MgO is very low, the reaction for the formation of the forsterite in the first half of the temperature rise in the final box annealing does not proceed, so that sealing effect cannot be attained by the film. In this case, even in the case of successful secondary recrystallization, the crystal orientation becomes very poor, or additional oxidation causes residual $SiO_2$, $Al_2O_3$ or their spinel to occur just under the surface of the steel sheet, which deteriorates the iron losses. For this reason, MgO is preferably limited to have such a particle size distribution such that 30% or more of the MgO particles have a diameter of 10 μm or less. When this proportion is less than 30%, the reactivity becomes so low that the above-described effect cannot be attained. Further, the CAA value of MgO is preferably limited to 50 to 300 sec. When this value is less than 50 sec, the progress of the hydration becomes very rapid for use on a commercial scale, so that it becomes difficult to control the hydrogen ig-loss. On the other hand, when the CAA value exceeds 300 sec, the reactivity of the MgO particles becomes so low that it becomes impossible to form a moderate forsterite in the first half of the final box annealing. The hydration ig-loss of MgO is preferably limited to 5% or less. When the water content exceeds 5%, the dew point between steel sheets becomes so high that additional oxidation occurs in the first half of the temperature rise, which makes it difficult to render the surface of the steel sheet homogeneously glassless. In extreme cases, this has an influence even on the inhibitor, which aggravates the poor secondary recrystallization.

With respect to additives to MgO, at least one member selected from chlorides, carbonates, nitrates, sulfates and sulfides of Lio K, Bi, Na, Ba, Ca, Mg, Zn, Fe, Zr, Sn, Sr, Al, etc. is incorporated in an amount of 2 to 30 parts by weight based on 100 parts by weight of MgO. The addition of these compounds first causes a moderately thin forsterite film to be formed on the surface of the steel sheet in the first half of the temperature rise in the finish annealing. Then, the formation of the forsterite is inhibited, and additional oxidation is prevented. In the second half of the temperature rise, the film layer is decomposed by an Fe etching reaction in the film layer, thus rendering the surface of the steel sheet glassless. When the amount of addition of these compounds is less than 2 parts by weight, the decomposition reaction of the forsterite formed in the first half of the temperature rise does not sufficiently proceed, so that the glass film unfavorably remains unremoved. On the other hand, when the amount of addition of the above-described compounds exceeds 30 parts by weight, component elements in the additive unfavorably diffuse and penetrate into the steel sheet to give rise to intergranular etching or to have an influence on the inhibitor or on subsequent purification treatment. The amount of addition is particularly preferably in the range of from 5 to 15 parts by weight.

Final box annealing conditions are very important to the process according to the present invention wherein the formation of a moderate glass film and the decomposition of the glass film are effected in the final box annealing.

In general, $N_2$, $H_2$ or a mixed gas comprising $N_2$ and $H_2$ is used as the atmosphere gas in the final box annealing of grain oriented electrical steel sheets. The use of a mixed gas comprising $N_2$ and $H_2$ is advantageous from the viewpoint of the regulation of oxidation on the surface of the steel sheet and the cost. In the present invention, in order to regulate the strength of the inhibitor in the reaction for rendering the surface of the steel sheet glassless, an atmosphere having a $N_2$ content of at least 30% or more and comprising $N_2$, $H_2$ and another inert gases is used as an atmosphere gas during the temperature rise. When the partial pressure of $N_2$ is less than 30%, the effect of preventing the weakening of (Al, Si)N caused during the reaction for rendering the surface of the steel sheet glassless cannot be attained, so that a material having a high magnetic flux density cannot be stably provided. The deterioration of the magnetic properties is significant particularly under such an atmosphere condition that the $N_2$ content is 20% or less. When the atmosphere comprises 100% of $N_2$, in some property values, oxidation occurs due to an increase in the degree of oxidation between steel sheets, which often causes the surface of the steel sheet to become uneven. The $N_2$ content is preferably in the range of from 30 to 90%.

In the use of a gas having a $N_2$ content of 30% or more, although the steel sheet may be annealed in this atmosphere over the whole period of the temperature rise, additional oxidation my occur depending upon MgO conditions, so that it is preferred to change the atmosphere gas after the temperature reaches about 700° C. which is most effective for stabilizing (Al, Si)N.

In the present invention, it is advantageous that the soaking temperature in the final box annealing is in the range of from 1180° to 1250° C. In the present invention, the material is in a glassless state at a point of time when the temperature has reached the soaking temperature in the final box annealing. The exposure of the material to the soaking temperature gives rise to further thermal etching, which renders the surface of the steel sheet specular, when the soaking temperature is below 1180° C., not only is this effect small but also the purification is disadvantaged. On the other hand, when the soaking temperature exceeds 1250° C., the effect of rendering the surface of the steel sheet specular is limited and there is a possibility that the form of the coil becomes poor and seizing occurs in the edge portion. The heating rate in the final box annealing is limited to 20° C./hr or less. when the heating rise rate exceeds this value, the decomposition rate of the inhibitor exceeds the growth rate of the secondary recrystallized grain, which inhibits the growth of crystal grains having an optimal orientation, so that the $B_8$ value falls.

Thereafter, the resultant steel sheet is coated with an insulating coating solution and subjected to heat flattening. In this case, a seam or spotty flaw, recess or groove is imparted to the surface of the steel sheet by a laser beam, a sprocket roll, a press, marking, local etching or the like before or after the heat flattening.

The conditions of the flaw, recess, or groove vary depending upon the usage of electrical steel sheets, when customers use the electrical steel sheet without effecting stress relieving annealing in the fabrication of iron cores, the depth may be as small as less than 5 μm for the purpose of utilizing the effect attained by a suitable strain. On the other hand, when the electrical steel sheet is used for the fabrication of a coil-wound core which requires stress relieving annealing, the flaw, recess or groove conditions are important. In this case, the flaw, recess or groove is imparted in a depth of 5 to 50 μm intervals of 2 to 15 mm and an angle of 45° to 90° to the rolling direction. The angle is preferably as close to 90° as possible. When an decrease in the angle is required for reasons of workability, the effect of provision of the flaw, recess or groove can be attained when the angle is 45° or more. Although the width of the flaw, recess or groove is not particularly limited, it is preferably as narrow as possible. When the depth is less than 5 μm, the effect of improving the iron loss value after annealing is small. On the other hand, when the depth exceeds 50 μm, the lowering in the magnetic flux density becomes large, which is disadvantageous from the viewpoint of properties at a high magnetic field. When the direction of the seam flaw is outside the above-described range, the effect of improving the iron loss cannot be attained, or there occurs a deterioration in the iron loss.

Then, an inorganic, organic or semi-organic coating solution agent or the like is used as an insulating coating solution forming agent for coating and baking depending upon the purpose of use of the electrical steel sheet. When the tension effect and heat resistance are required, the steel sheet is subjected to coating and baking with a treating agent composed mainly of colloidal silica and a phosphate or a treating agent consisting of a phosphate alone. The coating thickness is preferably limited to 2 to 6 μm. when the thickness is smaller than this range, no effect is attained. On the other hand, when the thickness exceeds this range, the lowering in the space factor causes properties to be lost when the product is incorporated into a transformer, when a good workability is required, the steel sheet is subjected to coating and baking with an inorganic, organic or semi-organic coating solution agent once or twice or more.

It is considered through the following mechanism that a material having an ultra low iron loss free from a glass film can be obtained by the present invention.

In the present invention, at the outset, a suitable amount of a glass film is formed in the first half of the step of the temperature rise in the final box annealing through the utilization of a suitable amount of an oxide film having a regulated reactivity formed in the decarburization annealing, MgO having a regulated reactivity and additives. This imparts a suitable sealing effect to the surface of the steel sheen, which contributes to stabilization of inhibitors such as AlN. Then, in the second half of the temperature rise in the final box annealing, etching and decomposition reaction of the glass film proceeds by virtue of the action of additives incorporated into MgO, such as chlorides, carbonates, sulfates, nitrates and sulfides. Further, in subsequent soaking at a high temperature in the final box annealing, a thermal etching effect occurs. In this stage, uneven portions of the surface of the matrix of the steel sheet caused by surface roughening during cold rolling, formation of an uneven oxide film in the decarburization annealing, etc. are smooth, so that the surface of the steel sheet becomes specular. This is because the movement of atoms on the surface during heat treatment at a high temperature is facilitated by rendering the surface of the steel sheet glassless, which lowers the surface tension, so that the surface of the steel sheet is smooth. In such a reaction process, the stabilization and strengthening of the inhibitor are important until the secondary recrystallization begins. For this reason, in the present invention, the $N_2$ partial pressure is controlled. This enables the stabilization of the inhibitor to be maintained, so that a grain oriented electrical steel sheet having a high magnetic flux density can be provided.

when the glassless grain oriented electrical steel sheet having a high magnetic flux density thus obtained is subjected to division of magnetic domain, a significant improvement in the iron loss can be attained over the iron loss of the conventional grain oriented electrical steel sheet having a glass film and a high magnetic flux density.

This effect is believed to reside in the following fact. Two effects, i.e., an effect derived from the freedom from a glass film and an internal oxide layer observed in products having a glass film and an effect refinning from the smooth surface having a low unevenness, prevent the occurrence of a pinning phenomenon in the movement of the domain wall during division of the magnetic domain. This combines with the effect of a high magnetic flux density to provide a significant effect, so that a material having an ultra low iron loss can be provided.

EXAMPLES

The function and effect of the present invention will now be descried with reference to the following Examples.

Example 1

A steel comprising, in terms of by weight, 3.50% of Si, 0.054% of C, 0.14% of Mn, 0.008% of S, 0.0295% of Al and 0.073% of N with the balance consisting of Fe and unavoidable impurities was cast into a slab by continuous casting. The slab was heated to 1,200° C., hot-rolled, annealed, pickled and cold-rolled into a sheet having a thickness of 0.22 mm which was then subjected to decarburization annealing for 110 sec. In this case, the decarburization annealing was effected on the two temperature levels of 830° C. and 840° C. The average grain diameter of the primary recrystallized grains and the proportion of grains having a diameter more than twice as large as the average grain diameter are shown in FIG. 2. The steel sheets subjected to decarburization annealing were nitrided to have a nitrogen (N) content of 226 ppm, coated with an annealing separator comprising a chloride, a carbonate, a nitrate, a sulfate or the like and then subjected to final box annealing. The high temperature final box annealing cycle was effected under two conditions shown in FIGS. 1(A) and 1(B). In a continuous line, the steel sheets subjected to secondary recrystallization was mildly pickled with 2.5% sulfuric acid solution at 80° C. for 10 sec, coated with an insulating coating solution agent comprising 50 kg of 50% $Al(H_2PO_4)_3$, 70 kg of 30% colloidal silica and 5 kg of $CrO_3$, and then subjected to baking and heat flattening at 850° C. for 30 sec. Thereafter, a strain was imparted to the steel sheets in the perpendicular direction to the rolling direction under conditions of intervals of 5 mm in the rolling direction, an irradiation width of 0.15 mm and an irradiation mark depth of 2.0 μm to provide final products.

Conditions for additive to annealing separators are listed in Table 1, and the test results are given in Table 2.

TABLE 1

| No. | Annealing Separator Conditions |
|---|---|
| 1 Invention | MgO 100 g + $CaCl_2$ 5 g |
| 2 Invention | MgO 100 g + $SnCl_2$ 7 g |
| 3 Invention | MgO 100 g + $Al_2(SO_4)_3$ 3 g |
| 4 Invention | MgO 100 g + $SrCl_2$ 5 g + $MgCl_2$ 5 g |
| 5 Invention | MgO 100 g + FeS 7 g + $K_2CO_3$ 8 g |
| 6 Comp. Ex. | MgO 100 g + $CaCl_2$ 0.5 g + $K_2CO_3$ 0.5 g |
| 7 Comp. Ex. | MgO 100 g + $TiO_2$ 5 g + $Na_2B_4O_7$ 0.2 g |

TABLE 2

Magnetic Properties of Product Sheet: $B_8$ value (T) /$W_{17/50}$ value (w/kg) (—: failure of secondary recrystallization)

| Annealing Separator No. | Decarburization Annealing Temp. | Final box Annealing Cycle A | Final box Annealing Cycle B (Comparative Material) |
|---|---|---|---|
| 1 | 830° C. | *1.96/0.63 | 1.86/0.87 |
| | 840° C. | 1.88/0.84 | — |
| 2 | 830° C. | *1.95/0.66 | 1.86/0.89 |
| | 840° C. | 1.86/0.88 | — |
| 3 | 830° C. | *1.94/0.69 | 1.84/0.92 |
| | 840° C. | 1.86/0.88 | — |
| 4 | 830° C. | *1.95/0.65 | 1.85/0.89 |
| | 840° C. | 1.87/0.86 | — |
| 5 | 830° C. | *1.94/0.69 | 1.85/0.90 |
| | 840° C. | 1.85/0.90 | — |
| 6 | 830° C. | 1.91/0.78 | 1.90/0.81 |
| | 840° C. | 1.89/0.81 | 1.90/0.81 |
| 7 | 830° C. | *1.92/0.78 | 1.91/0.79 |
| | 840° C. | 1.90/0.83 | 1.90/0.80 |

(*: Invention)

In all the materials of the present invention, the thickness of the oxide film on the surface of the steel sheet before coating with an insulating film was 0.3 μm or less, that is, the surface could be successfully rendered glassless. When the heating rate in the final box annealing was lowered, a very high $B_8$ value could be obtained by enhancing the $N_2$ partial pressure and lowering the decarburization annealing temperature.

Example 2

A steel material comprising, in terms of by weight, 0.054% of C, 3.35% of Si, 0.12% of Mn, 0.032% of acid soluble Al, 0.007% of S and 0.0072% of N with the balance consisting of Fe and unavoidable impurities was hot-rolled into a sheet having a thickness of 1.6 mm, annealed at 1130° C. for 2 min, pickled and cold-rolled into a sheet having a final thickness of 0.15 μm.

Then, the steel sheet was subjected to decarburization annealing under conditions of 25% $N_2$+ 75% $H_2$ and a dew point of 65° C. at 830° C. for 70 sec, and nitrided in a dry atmosphere comprising 25% of $N_2$, 75% of $H_2$ and $NH_3$ at 750° C. for 30 sec to have a nitrogen (N) content of 220 ppm, thereby providing a material under test. This steel sheet was coated with an annealing separator having a composition specified in Table 3, and final box annealing was effected with the atmosphere conditions being changed to those shown in FIGS. 1(A) and 1(C). This steel sheet was mildly pickled with 2% $H_2SO_4$ at 80° C. for 10 sec to activate the surface of the steel sheet. The surface of the steel sheet was coated with an insulating coating solution comprising 100 ml of 20% colloidal $SiO_2$, 25 ml of 50% monobasic aluminum phosphate, 25 ml of 50% monobasic magnesium phosphate and 7 g of chromic anhydride so that the thickness of the film after baking was 4 μm, and subjected to baking at 830° C. for 30 sec to provide a product. The surface appearance, coverage of glass film and magnetic properties of the steel sheets in this experiment are given in Table 4.

TABLE 3

| No. | Coating Conditions for Annealing Separator: MgO | Cl Content of Chloride | S Content | N Content of Nitride |
|---|---|---|---|---|
| 8 Invention | CAA 60 sec 100 pt. wt. | KCl 3 pt. wt. | CaS 1 pt. wt. | MnN 2 pt. wt. |
| 9 Invention | CAA 60 sec 100 pt. wt. | $CaCl_2$ 3 pt. wt. | $Na_2S$ 1 pt. wt. | MnN 2 pt. wt. |
| 10 Invention | CAA 60 sec 100 pt. wt. | $FeCl_3$ 3 pt. wt. | CuS 1 pt. wt. | MnN 2 pt. wt. |
| 11 Invention | CAA 60 sec 100 pt. wt. | $MgCl_2$ 1.5 + $CaCl_2$ 1.5 | $Al_2S_3$ 1 pt. wt. | MnN 2 pt. wt. |
| 12 Invention | CAA 60 sec 100 pt. wt. | $MnCl_2$ 1.5 + LiCl 1.5 | BaS 1 pt. wt. | MnN 2 pt. wt. |
| 13 Comp. Ex. | CAA 60 sec 100 pt. wt. + $TiO_2$ 5 pt. wt. + $Na_2B_4O_7$ 0.3 pt. wt. | | | |

TABLE 4

| Conditions for Final Box Annealing | Annealing Separator No. | Surface Appearance After Final Box Annealing | Coverage of Glass Film (g/m²) MgO | $SiO_2$ | $Al_2O_3$ | Flexural Property (times) | Number of times of Punching (×10⁴ Times) Burr Height at 50 μm | Magnetic Properties $B_8$ (T) | $W_{17/51}$ (w/kg) |
|---|---|---|---|---|---|---|---|---|---|
| (A) Invention | 8 Invention | Substantially uniform metallic gloss | 0.3 | 0.2 | 0.1 | 15 | 6.5 | 1.94 | 0.79 |
| | 9 Invention | Wholly uniform metallic gloss | 0.2 | 0.1 | 0.1 | 25 | 18.5 | 1.95 | 0.77 |
| | 10 Invention | Substantially uniform metallic gloss | 0.3 | 0.2 | 0.1 | 20 | 12.0 | 1.93 | 0.80 |
| | 11 Invention | Wholly uniform metallic gloss | 0.2 | 0.1 | 0.1 | 17 | 7.6 | 1.97 | 0.75 |
| | 12 Invention | Wholly uniform metallic gloss | 0.2 | 0.2 | 0.1 | 22 | 8.8 | 1.95 | 0.77 |
| | 13 Comp. Ex. | Uniformly thick glass film formed | 2.2 | 1.2 | 0.2 | 5 | 0.9 | 1.92 | 0.87 |
| (C) | 8 Inven- | Substantially uniform | 0.3 | 0.1 | 0.1 | 12 | | 1.87 | Poor secondary |

TABLE 4-continued

| Conditions for Final Box Annealing | Annealing Separator No. | Surface Appearance After Final Box Annealing | Coverage of Glass Film ($g/m^2$) MgO | $SiO_2$ | $Al_2O_3$ | Flexural Property (times) | Number of times of Punching ($\times 10^4$ Times) Burr Height at 50 μm | Magnetic Properties $B_8$ (T) | $W_{17/51}$ (w/kg) |
|---|---|---|---|---|---|---|---|---|---|
| Com. Ex. | tion | metallic gloss | | | | | | | recrystallization |
| | 9 Invention | Wholly uniform metallic gloss | 0.2 | 0.1 | 0.1 | 25 | | 1.83 | Poor secondary recrystallization |
| | 10 Invention | Substantially uniform metallic gloss | 0.4 | 0.2 | 0.1 | 17 | | 1.79 | Poor secondary recrystallization |
| | 11 Invention | Wholly uniform metallic gloss | 0.2 | 0.1 | 0.1 | 20 | | 1.87 | Poor secondary recrystallization |
| | 12 Invention | Wholly uniform metallic gloss | 0.1 | 0.05 | 0.1 | 22 | | 1.82 | Poor secondary recrystallization |
| | 13 Comp. Ex. | Uniformly thick glass film formed | 2.0 | 1.1 | 0.2 | 7 | | 1.91 | 0.85 |

As is apparent from the results, in all the materials coated with the annealing separators according to the present invention, the surface could be substantially completely rendered glassless and exhibited a metallic gloss, so that steel sheets having a specular surface could be provided. In all the materials according to the present invention, the coverage of glass was 1 $g/m^2$ or less, that is, the glass film was hardly formed. With respect to magnetic properties, all the materials subjected to final box annealing under conditions (A) had a high magnetic flux density and a low iron loss value, whereas all the materials subjected to final box annealing under comparative conditions (B) were poor in secondary recrystallization and had poor magnetic properties. All the materials according to the present invention were far superior to the comparative materials in the repeated flexural property. Further, with respect to the number of times of punching as well, the materials according to the present invention exhibited remarkably excellent results.

Example 3

The same material as that used in Example 2 was subjected to the same treatment as that of Example 2 and hot-rolled into a sheet having a final thickness of 0.225 min. This steel sheet was subjected to decarburization annealing under conditions of 25% $N_2$ 75% $H_2$ and a dew point of 65° C. at 840° C. for 90 sec, and subsequently annealed in a dry atmosphere comprising 25% of $N_2$, 75% of $H_2$ and $NH_3$ at 750° C. for 30 sec with the $NH_3$ content being varied to have a nitrogen (N) content of 200 ppm. Thereafter, the steel sheet was coated with an annealing separator having a composition specified in Table 5, and final box annealing was effected under conditions shown in FIGS. 1(A). The surface of the steel sheet was coated with a coating agent comprising 100 ml of 2.0% colloidal $SiO_2$, 50 ml of 50% $Mg(H_2PO_4)_2$ and 7 g of $CrO_3$ and subjected to baking with the film thickness being varied. The results on the state of the film and magnetic properties in this experiment are given in Table 6.

TABLE 5

| No. | Coating Conditions for Annealing Separator MgO | Cl Content of Chloride | S Content | N Content of Nitride |
|---|---|---|---|---|
| 14 Invention | CAA 75 sec 100 pt. wt. | $SnCl_2$ 1.5 pt. wt. | $MgSO_4$ 3.0 pt. wt. | $Si_3N_4$ 5 pt. wt. |
| 15 Invention | CAA 75 sec 100 pt. wt. | $SnCl_2$ 5.0 pt. wt. | $Ng_2SO_4$ 3.0 pt. wt. | $Si_3N_4$ 5 pt. wt. |
| 16 Invention | CAA 75 sec 100 pt. wt. | $SnCl_2$ 10.0 pt. wt. | $CuSO_4$ 3.0 pt. wt. | $Si_3N_4$ 5 pt. wt. |
| 17 Comp. Ex. | CAA 75 sec 100 pt. wt. + $TiO_2$ 5 pt. wt. + $Na_2B_4O_7$ 0.3 pt. wt. | | | |

TABLE 6

| Annealing Separator No. | Surface Appearance of Steel Surface After Final Box Annealing | Coverage of Glass Film ($g/m^2$) MgO | $SiO_2$ | $Al_2O_3$ | Thickness of Insulating Film (μm) | Magnetic Properties $B_8$ (T) | $W_{17/50}$ (w/kg) | N and S Contents of Product (ppm) |
|---|---|---|---|---|---|---|---|---|
| 14 Invention | Substantially uniform metallic gloss | 0.35 | 0.22 | 0.08 | 4.0 | 1.940 | 0.81 | 20 |
| 15 Invention | Uniform metallic gloss | 0.16 | 0.08 | 0.06 | 1.5 | 1.943 | 0.83 | 8 |
| 15 Invention | " | 0.16 | 0.080 | 0.06 | 3.0 | 1.940 | 0.79 | 8 |
| 15 Invention | " | 0.16 | .08 | 0.06 | 4.5 | 1.940 | 0.77 | 8 |
| 15 Invention | " | 0.16 | 0.08 | 0.06 | 6.0 | 1.935 | 0.79 | 8 |
| 16 Inven- | Uniform metallic gloss | 0.10 | 0.06 | 0.05 | 4.0 | 1.945 | 0.80 | 6 |

TABLE 6-continued

| Annealing Separator | Surface Appearance of Steel Surface After Final Box | Coverage of Glass Film ($g/m^2$) | | | Thickness of Insulating Film | Magnetic Properties | | N and S Contents of Product |
|---|---|---|---|---|---|---|---|---|
| No. | Annealing | MgO | $SiO_2$ | $Al_2O_3$ | (μm) | $B_8$ (T) | $W_{17/50}$ (w/kg) | (ppm) |
| tion | | | | | | | | |
| 17 Comp. Ex. | Uniform glass film formed | 2.00 | 1.11 | 0.18 | 4.0 | 1.923 | 0.93 | 55 |

As is apparent from the results, in all the materials according to the present invention, the surface could be significantly rendered glassless and exhibited a metallic gloss, and the coverage of the formed glass film was 1 $g/m^2$ or less. With respect to magnetic properties as well, all the materials coated with the annealing separator according to the present invention had good iron loss and magnetic flux density values. A particularly good iron loss value could be obtained when the film thickness was 3 μm or more. Also in the N and S contents of the steel, the glassless materials according to the present invention exhibited a significantly lower value than the comparative material having a glass film.

The comparative material having a glass film was unsuccessful in the purification and had a poor iron loss value.

Example 4

A steel material comprising, in terms of by weight, 0.054% of C, 3.35% of Si, 0.10% of Mn, 0.030% of acid soluble Al, 0.007% of S and 0.007% of N with the balance consisting of Fe and unavoidable impurities was hot-rolled into a sheet having a thickness of 2.0 mm, annealed at 1130° C. for 2 min, pickled and cold-rolled into a sheet having a final thickness of 0.225 mm.

Then, the steel sheet was subjected to decarburization annealing under conditions of 25% $N_2$+ 75% $H_2$ and a dew point of 55° C. at 830° C. for 100 sec, and nitrided in a dry atmosphere comprising 25% of $N_2$, 75% of $H_2$ and $NH_3$ at 750° C. for 30 sec to have a nitrogen (N) content of 250 ppm to provide a material under test.

Figure 1B:
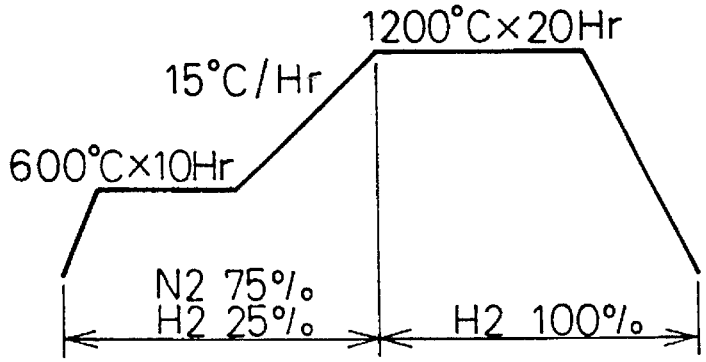
FIG. 1B is a diagram showing final box annealing conditions when the anneal atmosphere during the temperature raising portion of the annealing is 75% $N_2$ and 25% $H_2$.
Figure 1C:
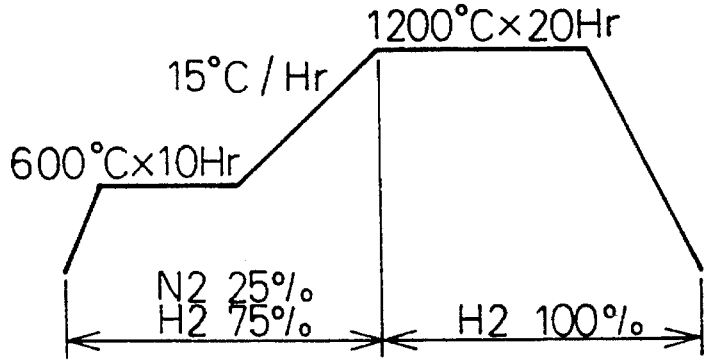
FIG. 1C is a diagram showing final box annealing conditions when the anneal atmosphere during the temperature raising portion of the annealing is 25% $N_2$ and 75% $H_2$.

This steel sheet was coated with an annealing separator having a composition specified in Table 7, and final box annealing was effected with the atmosphere conditions being changed to those shown in FIGS. 1(A) and 1(C). This steel sheet was mildly pickled with 2% $H_2SO_4$ at 80° C. for 10 sec to activate the surface of the steel sheet. The surface of the steel sheet was coated with an insulating coating solution agent comprising 80 ml of 20% colloidal $SiO_2$, 20 ml of 20% colloidal $ZrO_2$, 50 ml of 50% $Al(H_2PO_4)_3$ and 7 g-of $CrO_3$ so that the thickness of the film after baking was 4 μm, and subjected to baking at 830° C. for 30 sec to provide a product. The surface appearance, coverage of glass film and magnetic properties of steel sheets in this experiment are given in Table 7.

TABLE 7

| No. | Coating Conditions for Annealing Separator |
|---|---|
| 18 Invention | MgO 100 pt. wt. + $FeCl_3$ 10 pt. wt. |
| 19 Invention | MgO 100 pt. wt. + $CaCl_2$ 5 pt. wt. + CaS 5 pt. wt. |
| 20 Invention | MgO 100 pt. wt. + $BaCl_2$ 5 pt. wt. + KCl 5 pt. wt. |
| 21 Invention | MgO 100 pt. wt. + $SnCl_2$ 5 pt. wt. + $ZnCl_2$ 5 pt. wt. + MgS 5 pt. wt |
| 22 Invention | MgO 100 pt. wt. + NaCl 10 pt. wt. + FeS 10 pt. wt. |
| 23 Comp. Ex. | MgO 100 pt. wt. + $TiO_2$ 5 pt. wt. + $Na_2B_4O_7$ 0.3 pt. wt. |

TABLE 8

| Conditions for Final Box | Annealing Separator | Surface Appearance of Steel Surface After Final Box | Coverage of Glass Film ($g/m^2$) | | | Surface Roughness of Product | Magnetic Properties | | Punching Quality 50μ Burr |
|---|---|---|---|---|---|---|---|---|---|
| Annealing | No. | Annealing | MgO | $SiO_2$ | $Al_2O_3$ | Sheet Ra (μm) | $B_8$ (T) | $W_{17/50}$ (w/kg) | ($\times 10^4$ Times) |
| (A) Invention | 18 Invention | Substantially uniform metallic gloss | 0.3 | 0.2 | 0.05 | 0.13 | 1.93 | 0.84 | 7.5 |
| | 19 Invention | Wholly uniform metallic gloss | 0.15 | 0.06 | 0.07 | 0.08 | 1.95 | 0.81 | 15.0 |
| | 20 Invention | Wholly uniform metallic gloss | 0.15 | 0.10 | 0.05 | 0.06 | 1.95 | 0.82 | 13.0 |
| | 21 Invention | Substantially uniform metallic gloss | 0.25 | 0.18 | 0.10 | 0.10 | 1.94 | 0.84 | 8.3 |
| | 22 Invention | Substantially uniform metallic gloss | 0.20 | 0.16 | 0.10 | 0.13 | 1.93 | 0.83 | 6.7 |
| | 23 Comp. Ex. | Uniformly thick glass film formed | 2.3 | 1.2 | 0.17 | 0.21 | 1.92 | 0.89 | 0.6 |
| (C) Com. Ex. | 18 Invention | Substantially uniform metallic gloss | 0.3 | 0.16 | 0.07 | 0.12 | 1.87 | — | |
| | 19 Inven- | Wholly uniform | 0.1 | 0.05 | 0.05 | 0.08 | 1.84 | — | |

TABLE 8-continued

| Conditions for Final Box Annealing | Annealing Separator No. | Surface Appearance of Steel Surface After Final Box Annealing | Coverage of Glass Film ($g/m^2$) MgO | $SiO_2$ | $Al_2O_3$ | Surface Roughness of Product Sheet Ra (μm) | Magnetic Properties $B_8$ (T) | $W_{17/50}$ (w/kg) | Punching Quality 50μ Burr ($\times 10^4$ Times) |
|---|---|---|---|---|---|---|---|---|---|
| | tion | metallic gloss | | | | | | | |
| | 20 Invention | Wholly uniform metallic gloss | 0.15 | 0.1 | 0.05 | 0.07 | 1.83 | — | |
| | 21 Invention | Substantially uniform metallic gloss | 0.3 | 0.18 | 0.08 | 0.13 | 1.87 | — | |
| | 22 Invention | Substantially uniform metallic gloss | 0.2 | 0.1 | 0.12 | 0.14 | 1.85 | — | |
| | 23 Comp. Ex. | Uniformly thick glass film formed | 2.0 | 1.0 | 0.16 | 0.20 | 1.93 | 0.86 | |

As is apparent from the results, in all the materials according to the present invention, the surface could be substantially rendered completely glassless, and a good glassless uniform surface appearance could be obtained. With respect to magnetic properties, all the materials subjected to finish annealing under conditions (A) had a high magnetic flux density and a lower iron loss value than the comparative material having a glass film, whereas all the materials subjected to final box annealing under conditions (C) had an extremely low magnetic flux density and were a poor material. All the materials according to the present invention were far superior in the surface roughness to the materials having a glass film, that is, it was confirmed that the surface appearance was improved by the present invention. Further, the materials according to the present invention exhibited a great improvement in the punchability as a measure for the evaluation of workability.

Example 5

The same material as that used in Example 4 was subjected to the same treatment as that of Example 4 and rolled into a sheet having a final thickness of 0.225 mm. A seam flaw was imparted to the steel sheet by using a laser beam in the rolling direction and a direction normal to the rolling direction of the steel sheet under conditions of an interval of 5 mm, a depth of 5 μm and a width of 100 μm, and the steel sheet was then subjected to decarburization annealing under conditions of 25% $N_2$+75% $H_2$ at 830° C. for 100 sec and nitrided in an atmosphere comprising 25% of $N_2$, 75% of $H_2$ and $NH_3$ to have a nitrogen (N) content of 220 ppm. Thereafter, the steel sheet was coated with an annealing separator having a composition specified in Table 9, and final box annealing was effected under conditions shown in FIG. 1(A). The surface of the steel sheet was coated with an insulating film forming agent comprising 70 cc of 20% colloidal $SiO_2$, 25 cc of 20% colloidal $ZrO_2$, 5 cc of 20% colloidal $SnO_2$, 50 cc of 50% monobasic magnesium phosphate and 5 g of $CrO_3$ and subjected to baking with the coating thickness being varied. The results on the state of the film and magnetic properties in this experiment are given in Table 10.

TABLE 9

| No. | Coating Conditions for Annealing Separator |
|---|---|
| 24 Invention | MgO 100 pt. wt. + $MnCl_2$ 10 pt. wt. + $SnCl_2$ 5 pt. wt. |
| 25 Invention | MgO 100 pt. wt. + $CaCl_2$ 5 pt. wt. + $MgCl_2$ 5 pt. wt. + SrS 5 pt. wt. |
| Comp. Ex. | MgO 100 pt. wt. + $TiO_2$ 5 pt. wt. + $Na_2B_4O_7$ 0.3 pt. wt. |

TABLE 10

| Annealing Separator No. | Surface Appearance of Steel Surface After Final Box Annealing | Coverage of Glass Film ($g/m^2$) MgO | $SiO_2$ | $Al_2O_3$ | Thickness of insulating Film (μm) | Magnetic Properties $B_8$ (T) | $W_{17/50}$ (w/kg) |
|---|---|---|---|---|---|---|---|
| 24 Invention | Wholly uniform metallic gloss | 0.25 | 0.2 | 0.06 | 1.5 | 1.945 | 0.84 |
| | | | | | 3.0 | 1.940 | 0.75 |
| | | | | | 4.5 | 1.930 | 0.70 |
| | | | | | 6.0 | 1.922 | 0.73 |
| 25 Invention | Wholly uniform metallic gloss | 0.15 | 0.10 | 0.05 | 1.5 | 1.942 | 0.86 |
| | | | | | 3.0 | 1.930 | 0.80 |
| | | | | | 4.5 | 1.920 | 0.72 |
| | | | | | 6.0 | 1.910 | 0.75 |
| 26 Comp. Ex. | Uniform glass film formed | 2.5 | 1.4 | 0.15 | 1.5 | 1.928 | 0.83 |
| | | | | | 3.0 | 1.920 | 0.78 |
| | | | | | 4.5 | 1.909 | 0.82 |
| | | | | | 6.0 | 1.892 | 0.89 |

As is apparent from the results, in all the materials according to the present invention, the surface could be substantially completely rendered glassless and exhibited a metallic gloss. On the other hand, in the material coated with a comparative annealing separator, a uniform glass film was formed as with Example 4. With respect to magnetic properties as well, all the materials subjected according to the present invention had a good iron loss value, and a particularly good iron loss value was obtained when the coverage of the insulating film was 3 to 4.5 μm. By contrast, in the comparative material, the attained iron loss values were inferior to those in the materials according to the present invention.

Example 6

Steels comprising chemical ingredients as specified in Tables 11 and 14 were produced by a melt process in a converter. Steel sheets were produced under conditions as specified in Tables 12, 13, 15 and 16. In some steel sheets, annealing of hot-rolled sheets were effected at 1120° C. for 30 sec. All the materials except for material NOS. 41 to 46 were subjected to aging between passes of the cold rolling. The aging was effected at 250° C. Nitriding which is especially important to the present invention following the primary recrystallization annealing, was effected in a portion of an identical furnace provided with a partition by using a dry atmosphere comprising an identical gas composition while flowing $NH_3$ gas at a constant flow rate. The nitrogen content after the primary recrystallization are given in Tables 12 and 15. The steel sheets were coated with a powder. In this case, the powder was dissolved in water to provide a slurry, and the slurry was coated on the surface of the steel sheets to provide a coating which was then dried at 250° C. The "%" of the additive is percentage by weight when the weight of MgO is supposed to be 100%. Thereafter, final box annealing was effected with the average temperature rise rate from 800° C. to the maximum temperature being varied. In this case, the maximum temperature was 1,200° C. Further, a phosphate high-tension insulating film (a secondary film) was coated on and heated the steel sheets which were then subjected to blanking, stress relieving annealing at 850° C. for 4 hr in a dry atmosphere comprising 90% $N_2$ and 10% $H_2$ and then magnetic measurement. The results are given in Tables 13 and 16. All the maximum depth, pitch and angle to the rolling direction of grooves measurements are for products after the final box annealing.

The magnetic measurement was effected by SST testing method for a single sheet having a size of 60× 300 mm. In this test, the $B_8$ value [magnetic flux density (Tesla) at 800 A/m) and $W_{17/50}$ (iron loss value (w/kg) in 1.7 Tesla at 50 Hz) and $W_{13/50}$ (iron loss value (w/kg) in 1.3 Tesla at 50 Hz) were measured.

As is apparent from Tables 13 and 16, the materials falling within the scope of the present invention had a high magnetic flux density and a sufficiently low iron loss and can attain the object of the present invention.

TABLE 11

| | Chemical Components (wt. %) | | | | | | | | | Heat-Temp. in Hot- | Anneal-ing of Hot | Reduction Ratio in Cold Rolling (%) (/: Numerator represents reduction ratio in 1st rolling with denominator |
|---|---|---|---|---|---|---|---|---|---|---|---|---|
| No. | C | Si | Mn | P | S | Sol. Al | N | O | Other element | Rolling (°C.) | Rolled Sheet | representing reduction ratio in 2nd rolling |
| 27 | 0.06 | 3.50 | 0.12 | 0.090 | 0.007 | 0.028 | 0.0078 | 0.005 | Sn 0.08 | 1150 | Done | 89 |
| 28 | 0.06 | 3.50 | 0.12 | 0.090 | 0.007 | 0.028 | 0.0078 | 0.005 | Cu 0.151 | 1150 | Done | 89 |
| 29 | 0.06 | 3.50 | 0.12 | 0.090 | 0.007 | 0.028 | 0.0078 | 0.005 | ↓ | 150 | Done | 89 |
| 30 | 0.06 | 3.50 | 0.12 | 0.090 | 0.007 | 0.028 | 0.0078 | 0.005 | ↓ | 1150 | Not done | 89 |
| 31 | 0.06 | 3.50 | 0.12 | 0.090 | 0.007 | 0.028 | 0.0078 | 0.005 | ↓ | 1150 | Not done | 89 |
| 32 | 0.06 | 3.50 | 0.12 | 0.090 | 0.007 | 0.028 | 0.0078 | 0.005 | ↓ | 1150 | Not done | 89 |
| 33 | 0.06 | 3.50 | 0.12 | 0.090 | 0.007 | 0.028 | 0.0078 | 0.005 | ↓ | 1150 | Not done | 89 |
| 34 | 0.06 | 3.50 | 0.12 | 0.090 | 0.007 | 0.028 | 0.0078 | 0.005 | ↓ | 1150 | Not done | 89 |
| 35 | 0.06 | 3.50 | 0.12 | 0.090 | 0.007 | 0.028 | 0.0078 | 0.005 | ↓ | 1150 | Not done | 89 |
| 36 | 0.06 | 3.50 | 0.12 | 0.090 | 0.009 | 0.028 | 0.0078 | 0.005 | ↓ | 1150 | Not done | 89 |
| 37 | 0.06 | 3.50 | 0.12 | 0.090 | 0.007 | 0.028 | 0.0078 | 0.005 | ↓ | 1150 | Not done | 89 |
| 38 | 0.06 | 3.50 | 0.12 | 0.090 | 0.007 | 0.028 | 0.0078 | 0.005 | ↓ | 1150 | Not done | 89 |
| 39 | 0.06 | 3.50 | 0.12 | 0.090 | 0.007 | 0.028 | 0.0078 | 0.005 | ↓ | 1150 | Not done | 89 |
| 40 | 0.06 | 3.50 | 0.12 | 0.090 | 0.007 | 0.028 | 0.0078 | 0.001 | ↓ | 1150 | Not done | 89 |

TABLE 12

| | | Grooving | | | Primary Annealing | | | Anneling Separator Conditions | |
|---|---|---|---|---|---|---|---|---|---|
| | | Average | | Angle to | | Nitriding | | | Other |
| No. | Method | Max. Depth (μ) | Pitch (mm) | Rolling Direc-tion (°) | Temp. (°C.) | Done or Not Done | N Content (ppm) | $TiO_2$ (wt. %) | Additive (wt. %) |
| 27 | Rolling | 20 | 6 | 90 | 830 | Done | 180 | 5 | $CaCl_2$ 8 |
| 28 | Rolling | 65 | 6 | 90 | 830 | Done | 180 | 5 | $CaCl_2$ 8 |
| 29 | Rolling | 1 | 6 | 80 | 830 | Done | 180 | 5 | $CaCl_2$ 8 |
| 30 | HCl etching | 18 | 10 | 90 | 830 | Done | 180 | 0 | $K_2S$ 5 |
| 31 | HCl etching | 18 | 23 | 90 | 820 | Done | 180 | 0 | $K_2S$ 5 |

TABLE 12-continued

| No. | Method | Grooving: Average Max. Depth (μ) | Grooving: Pitch (mm) | Grooving: Angle to Rolling Direction (°) | Primary Annealing: Temp. (°C.) | Primary Annealing: Nitriding: Done or Not Done | Primary Annealing: Nitriding: N Content (ppm) | Anneling Separator Conditions: $TiO_2$ (wt. %) | Anneling Separator Conditions: Other Additive (wt. %) |
|---|---|---|---|---|---|---|---|---|---|
| 32 | HCl etching | 18 | 1 | 90 | 810 | Done | 180 | 0 | $K_2S$ 5 |
| 33 | HCl etching | 18 | 9 | 40 | 810 | Done | 180 | 0 | $K_2S$ 5 |
| 34 | Laser + etching | 6 | 1 | 75 | 850 | Done | 180 | 2 | $CaCl_2$ 4 |
| 35 | Laser + etching | 6 | 5 | 75 | 850 | Done | 180 | 2 | $CaCl_2$ 4 |
| 36 | Laser + etching | 1 | 5 | 75 | 850 | Done | 180 | 2 | $CaCl_2$ 4 |
| 37 | Laser + etching | 4 | 5 | 75 | 850 | Done | 180 | 2 | $CaCl_2$ 4 |
| 38 | Laser + etching | 4 | 5 | 30 | 850 | Done | 180 | 2 | $CaCl_2$ 4 |
| 39 | Laser + etching | 4 | 5 | 80 | 850 | Done | 180 | 2 | $CaCl_2$ 4 |
| 40 | Laser + etching | 4 | 5 | 90 | 850 | Done | 180 | 5 | |

TABLE 13

| No. | Final Box Annealing: Composition of Atmosphere Gas | Final Box Annealing: Temp. Rise Rate (°C./hr) | Final Box Annealing: Average Thickness of Primary Film (μm) | Thickness of Product Sheet (mm) | Magnetic Property Values of Product: Magnetic Flux Density $B_8$ (Tesla) | Magnetic Property Values of Product: Iron Loss (Watt/kg) $W_{17/50}$ | Magnetic Property Values of Product: Iron Loss (Watt/kg) $W_{13/60}$ | V: Invention |
|---|---|---|---|---|---|---|---|---|
| 27 | $N_2$ 60%, $H_2$ 40% | 7 | Free | 0.23 | 1.97 | 0.60 | 0.32 | v |
| 28 | $N_2$ 60%, $H_2$ 40% | 7 | 0.1 | 0.23 | 1.88 | 0.81 | 0.45 | |
| 29 | $N_2$ 60%, $H_2$ 40% | 7 | Free | 0.23 | 1.94 | 0.74 | 0.40 | |
| 30 | $N_2$ 40%, $H_2$ 60% | 15 | 0.2 | 0.23 | 1.98 | 0.61 | 0.34 | v |
| 31 | $N_2$ 40%, $H_2$ 60% | 15 | 0.2 | 0.23 | 1.97 | 0.74 | 0.41 | |
| 32 | $N_2$ 40%, $H_2$ 60% | 15 | 0.1 | 0.23 | 1.96 | 0.76 | 0.40 | |
| 33 | $N_2$ 40%, $H_2$ 60% | 15 | 0.1 | 0.23 | 1.95 | 0.77 | 0.41 | |
| 34 | $N_2$ 50%, $H_2$ 50% | 15 | 0.3 | 0.23 | 1.95 | 0.80 | 0.43 | |
| 35 | $N_2$ 50%, $H_2$ 50% | 15 | 0.2 | 0.23 | 1.96 | 0.58 | 0.31 | v |
| 36 | $N_2$ 50%, $H_2$ 50% | 15 | 0.3 | 0.23 | 1.94 | 0.74 | 0.42 | |
| 37 | $N_2$ 20%, $H_2$ 80% | 15 | 0.3 | 0.23 | 1.88 | 0.84 | 0.48 | |
| 38 | $N_2$ 80%, $H_2$ 20% | 15 | 0.3 | 0.23 | 1.96 | 0.96 | 0.54 | |
| 39 | $N_2$ 80%, $H_2$ 20% | 38 | 0.3 | 0.23 | 1.94 | 0.71 | 0.39 | |
| 40 | $N_2$ 80%, $H_2$ 20% | 10 | 1.2 | 0.23 | 1.96 | 0.72 | 0.40 | |

TABLE 14

| No. | Chemical Components (wt. %): C | Si | Mn | P | S | Sol. Al | N | O | Other element | Heat-Temp. in Hot-Rolling (°C.) | Annealing of Hot Rolled Sheet (Done or Not Done) | Reduction Ratio in Cold Rolling (%) (/: Numerator represents reduction ratio in 1st rolling with denominator representing reduction ratio in 2nd rolling |
|---|---|---|---|---|---|---|---|---|---|---|---|---|
| 41 | 0.08 | 2.90 | 0.08 | 0.025 | 0.020 | 0.003 | 0.0030 | 0.006 | Cu 0.10 | 1350 | Not done | 50/80 |
| 42 | 0.08 | 2.90 | 0.08 | 0.025 | 0.020 | 0.003 | 0.0030 | 0.006 | Cr 0.10 | 1350 | Not done | 50/80 |
| 43 | 0.08 | 2.90 | 0.08 | 0.025 | 0.020 | 0.003 | 0.0030 | 0.006 | ↓ | 1350 | Not done | 50/80 |
| 44 | 0.08 | 2.90 | 0.08 | 0.025 | 0.020 | 0.003 | 0.0030 | 0.006 | ↓ | 1350 | Not done | 50/80 |
| 45 | 0.08 | 2.90 | 0.08 | 0.025 | 0.020 | 0.003 | 0.0030 | 0.006 | ↓ | 1350 | Not done | 50/80 |
| 46 | 0.08 | 2.90 | 0.08 | 0.025 | 0.020 | 0.003 | 0.0030 | 0.006 | ↓ | 1350 | Not done | 50/80 |
| 47 | 0.05 | 0.05 | 0.15 | 0.070 | 0.004 | 0.028 | 0.0080 | 0.005 | ↓ | 1200 | Done | 90 |
| 48 | 0.06 | 8.00 | 0.12 | 0.065 | 0.006 | 0.030 | 0.0060 | 0.009 | Sn 0.10 | 1150 | Done | 88 |
| 49 | 0.006 | 4.50 | 0.20 | 0.055 | 0.004 | 0.026 | 0.0060 | 0.005 | Sb 0.05 | 1150 | Done | 90 |
| 50 | 0.006 | 4.50 | 0.20 | 0.055 | 0.004 | 0.026 | 0.0060 | 0.005 | Se 0.10 | 1150 | Done | 90 |
| 51 | 0.006 | 4.50 | 0.20 | 0.055 | 0.004 | 0.026 | 0.0060 | 0.005 | ↓ | 1150 | Done | 90 |
| 52 | 0.006 | 4.50 | 0.20 | 0.055 | 0.004 | 0.026 | 0.0060 | 0.005 | ↓ | 1150 | Done | 90 |

TABLE 14-continued

| No. | Chemical Components (wt. %) C | Si | Mn | P | S | Sol. Al | N | O | Other element | Heat-Temp. in Hot-Rolling (°C.) | Anneal-ing of Hot Rolled Sheet (Done or Not Done) | Reduction Ratio in Cold Rolling (%) (/: Numerator represents reduction ratio in 1st rolling with denominator representing reduction ratio in 2nd rolling |
|---|---|---|---|---|---|---|---|---|---|---|---|---|
| 53 | 0.006 | 4.50 | 0.20 | 0.055 | 0.004 | 0.026 | 0.0060 | 0.005 | ↓ | 1150 | Done | 90 |
| 54 | 0.006 | 4.50 | 0.20 | 0.055 | 0.004 | 0.026 | 0.0060 | 0.005 | ↓ | 1150 | Done | 90 |
| 55 | 0.006 | 4.50 | 0.20 | 0.055 | 0.004 | 0.026 | 0.0060 | 0.005 | ↓ | 1150 | Done | 90 |
| 56 | 0.006 | 4.50 | 0.20 | 0.055 | 0.004 | 0.026 | 0.0060 | 0.005 | ↓ | 1150 | Done | 90 |
| 57 | 0.006 | 4.50 | 0.20 | 0.055 | 0.004 | 0.026 | 0.0060 | 0.005 | ↓ | 1150 | Done | 90 |
| 58 | 0.06 | 3.15 | 0.15 | 0.060 | 0.007 | 0.029 | 0.0060 | 0.008 | Sn 0.06 | 1150 | Done | 88 |
| 59 | 0.06 | 3.15 | 0.15 | 0.060 | 0.007 | 0.029 | 0.0060 | 0.008 | Sn 0.20 | 1150 | Done | 88 |
| 60 | 0.06 | 3.15 | 0.15 | 0.060 | 0.007 | 0.029 | 0.0060 | 0.008 | Sn 0.30 | 1150 | Done | 88 |
| 61 | 0.06 | 3.15 | 0.15 | 0.060 | 0.007 | 0.029 | 0.0060 | 0.008 | ↓ | 1150 | Done | 88 |

TABLE 15

| No. | Method | Grooving: Average Max. Depth (μ) | Pitch (mm) | Angle to Rolling Direction (°) | Primary Annealing: Temp. (°C.) | Nitriding: Done or Not Done | N Content (ppm) | Anneling Separator Conditions: $TiO_2$ (wt. %) | Other Additive (wt. %) |
|---|---|---|---|---|---|---|---|---|---|
| 41 | Pressing | 20 | 6 | 85 | 850 | Not done | — | 2 | $K_2S$ 8 |
| 42 | — | — | — | 85 | 850 | Not done | — | 2 | $K_2S$ 8 |
| 43 | Plasma + etching | 3 | 4 | 90 | 900 | Not done | — | 0 | $CaCl_2$ 5 |
| 44 | Plasma + etching | 3 | 10 | 90 | 900 | Not done | — | 0 | $CaCl_2$ 5 |
| 45 | Plasma + etching | 1 | 10 | 90 | 900 | Not done | — | 0 | $CaCl_2$ 5 |
| 46 | Plasma + etching | 4 | 4 | 90 | 900 | Not done | — | 0 | — |
| 47 | Pressing | 25 | 7 | 88 | 830 | Done | 140 | 4 | $CaCl_2$ 5 |
| 48 | Rolling | 10 | 4 | 88 | 860 | Done | 190 | 5 | $CaCl_2$ 12 |
| 49 | Cutter + etching | 25 | 5 | 90 | 830 | Done | 200 | 12 | $CaCl_2$ 6 |
| 50 | Cutter + etching | 4 | 5 | 90 | 830 | Done | 200 | 12 | $CaCl_2$ 6 |
| 51 | Cutter + etching | 1 | 5 | 90 | 830 | Done | 200 | 12 | $CaCl_2$ 6 |
| 52 | Cutter + etching | 58 | 5 | 90 | 830 | Done | 200 | 12 | $CaCl_2$ 6 |
| 53 | Cutter + etching | 12 | 20 | 90 | 830 | Done | 200 | 12 | $CaCl_2$ 6 |
| 54 | Cutter + etching | 5 | 5 | 90 | 830 | Done | 200 | 5 | $CaCl_2$ 0.3 |
| 55 | Cutter + etching | 5 | 5 | 90 | 830 | Done | 200 | 5 | $K_2S$ 26 |
| 56 | Cutter + etching | 5 | 5 | 90 | 830 | Done | 200 | 5 | $K_2S$ 25 |
| 57 | Cutter + etching | 20 | 5 | 90 | 830 | Done | 200 | 5 | $K_2S$ 20 |
| 58 | Pressing | 10 | 3 | 80 | 830 | Done | 180 | 2 | $CaCl_2$ 10 |
| 59 | Pressing | 10 | 3 | 80 | 830 | Done | 180 | 2 | $CaCl_2$ 10 |
| 60 | Pressing | 10 | 3 | 80 | 830 | Done | 180 | 2 | $CaCl_2$ 10 |
| 61 | Pressing | 10 | 3 | 80 | 830 | Done | 180 | 2 | $CaCl_2$ 10 |

TABLE 16

| No. | Final Box Annealing: Composition of Atmosphere Gas | Temp. Rise Rate (°C./hr) | Average Thickness of Primary Film (μm) | Thickness of Product Sheet (mm) | Magnetic Property Values of Product: Magnetic Flux Density $B_8$ (Tesla) | Iron Loss (Watt/kg) $W_{17/50}$ | $W_{13/60}$ | ○: Invention |
|---|---|---|---|---|---|---|---|---|
| 41 | $N_2$ 30%, $H_2$ 70% | 25 | Free | 0.15 | 1.87 | 0.70 | 0.37 | |
| 42 | $N_2$ 30%, $H_2$ 70% | 25 | Free | 0.15 | 1.87 | 0.98 | 0.57 | |
| 43 | $N_2$ 30%, $H_2$ 70% | 25 | Free | 0.15 | 1.84 | 0.88 | 0.48 | |
| 44 | $N_2$ 30%, $H_2$ 70% | 25 | Free | 0.15 | 1.83 | 0.89 | 0.48 | |
| 45 | $N_2$ 30%, $H_2$ 70% | 25 | Free | 0.15 | 1.86 | 1.00 | 0.56 | |
| 46 | $N_2$ 30%, $H_2$ 70% | 25 | 1.5 | 0.15 | 1.88 | 0.98 | 0.55 | |
| 47 | $N_2$ 70%, $H_2$ 30% | 15 | 0.1 | 0.18 | 1.60 | 1.30 | 0.90 | |
| 48 | $N_2$ 50%, $H_2$ 50% | 10 | 0.9 | 0.23 | 1.87 | 0.84 | 0.42 | |
| 49 | $N_2$ 50%, $H_2$ 50% | 10 | Free | 0.15 | 1.97 | 0.48 | 0.21 | ○ |
| 50 | $N_2$ 50%, $H_2$ 50% | 10 | Free | 0.15 | 1.97 | 0.43 | 0.18 | ○ |

TABLE 16-continued

| No. | Final Box Annealing: Composition of Atmosphere Gas | Final Box Annealing: Temp. Rise Rate (°C./hr) | Final Box Annealing: Average Thickness of Primary Film (μm) | Thickness of Product Sheet (mm) | Magnetic Property Values of Product: Magnetic Flux Density $B_8$ (Tesla) | Magnetic Property Values of Product: Iron Loss (Watt/kg) $W_{17/50}$ | Magnetic Property Values of Product: Iron Loss (Watt/kg) $W_{13/60}$ | ○: Invention |
|---|---|---|---|---|---|---|---|---|
| 51 | $N_2$ 50%, $H_2$ 50% | 10 | 0.1 | 0.15 | 1.97 | 0.65 | 0.36 | |
| 52 | $N_2$ 50%, $H_2$ 50% | 10 | 0.1 | 0.15 | 1.98 | 0.69 | 0.37 | |
| 53 | $N_2$ 50%, $H_2$ 50% | 10 | 0.1 | 0.15 | 1.98 | 0.68 | 0.38 | |
| 54 | $N_2$ 50%. $H_2$ 50% | 10 | 0.2 | 0.15 | 1.93 | 0.74 | 0.40 | |
| 55 | $N_2$ 50%, $H_2$ 50% | 10 | 0.6 | 0.15 | 1.92 | 0.71 | 0.38 | |
| 56 | $N_2$ 50%, $H_2$ 50% | 45 | Free | 0.15 | 1.90 | 0.68 | 0.36 | |
| 57 | $N_2$ 50%, $H_2$ 50% | 10 | Free | 0.15 | 1.97 | 0.59 | 0.30 | ○ |
| 58 | $N_2$ 50%, $H_2$ 50% | 10 | Free | 0.23 | 1.96 | 0.62 | 0.33 | ○ |
| 59 | $N_2$ 50%, $H_2$ 50% | 10 | Free | 0.23 | 1.96 | 0.54 | 0.26 | ○ |
| 60 | $N_2$ 50%, $H_2$ 50% | 10 | Free | 0.23 | 1.97 | 0.53 | 0.24 | ○ |
| 61 | $N_2$ 50%, $H_2$ 50% | 10 | Free | 0.23 | 1.91 | 0.76 | 0.44 | |

As is apparent from the above-described Examples, according to the present invention, grain oriented electrical steel sheets not having a glass film and having a very high magnetic flux density and an ultra low iron loss, particularly grain oriented electrical steel sheets having a high magnetic flux density and a low iron loss and significantly excellent in the workability, such as slittability, cuttability and punchability, can be produced at a low cost.

I claim:

1. A process for producing a grain oriented electrical steel sheet having a high magnetic flux density and an excellent iron loss property, said process comprising the steps of: heating a slab comprising, in terms of % by weight, 0.021 to 0.075% of C, 2.5 to 4.5% of Si, 0.010 to 0.040% of acid soluble Al, 0.0030 to 0.0130% of N, 0.0140% or less of S, 0.05 to 0.45% of Mn, and 0.03% or more of P with the balance consisting of Fe and unavoidable impurities at a temperature below 1,280° C., hot-rolling the heated slab and optionally subjecting the hot-rolled sheet to annealing, subjecting the steel sheet to once or twice or more cold rolling with annealing between the cold rollings being effected to provide a steel sheet having a final thickness, subjecting the cold-rolled sheet to decarburization annealing, nitriding the steel sheet after decarburization annealing, coating the nitrided steel sheet with an annealing separator, subjecting the coated steel sheet to final box annealing in an atmosphere containing 30% or more nitrogen during temperature raising portion of the final annealing, and coating the annealed steel sheet with an insulating film, wherein said annealing separator comprises MgO and at least a Cl compound in an amount of 1 part by weight or more in terms of Cl based on 100 parts by weight of MgO.

2. The process for producing a grain oriented electrical steel sheet having a high magnetic flux density and an excellent iron loss property according to claim 1, wherein said annealing separator contains as an additive at least one member selected from the group consisting of S compounds, carbonates, and nitrates in an amount of 1 to 15 parts by weight in terms of the total amount of S, and ($CO_3$).

3. The process for producing a grain oriented electrical steel sheet having a high magnetic flux density and an excellent iron loss property according to claim 1, wherein the amount of oxygen added to the steel sheet in the decarburization annealing is such that total oxygen content of the steel is 900 ppm or less and the Fe-oxide to $SiO_2$ ratio in the oxide film is 0.20 or less.

4. The process for producing a grain oriented electrical steel sheet having a high magnetic flux density and an excellent iron loss property according to claim 1, wherein the amount of nitrogen added to the steel sheet in the nitriding treatment process is such that total nitrogen content of the steel is 150 ppm or more.

5. The process for producing a grain oriented electrical steel sheet having a high magnetic flux density and an excellent iron loss property according to claim 1 or 2, wherein said annealing separator comprises 100 parts by weight of MgO and, added thereto, 2 to 30 parts by weight of at least one member selected from the group consisting of carbonates, nitrates, sulfates and sulfides of Li, K, Bi, Na, Ba, Ca, Mg, Zn, Fe, Zr, Sn, Sr, Al, the MgO used in the annealing separator having such a particle size that 30% or more of the MgO consists of particles having a diameter of 10 μm less, a citric acid activity (CAA value) of 50 to 300 sec (as measured at 30° C.) and a hydration ig-loss of 5% or less.

6. The process for producing a grain oriented electrical steel sheet having a high magnetic flux density and an excellent iron loss property according to claim 1, wherein the heating in the final box annealing is effected in an atmosphere comprising $N_2$ and $H_2$ with the nitrogen content being 30% or more at a heating rate of 20° C./hr or less.

7. The process for producing a grain oriented electrical steel sheet having a high magnetic flux density and an excellent iron loss property according to claim 1, wherein, in the coating of the steel sheet with the insulating film, a baking treatment is effected once or twice or more so that the film thickness after baking is in the range of from 2 to 6 μm.

8. The process for producing a grain oriented electrical steel sheet having a high magnetic flux density and an excellent iron loss property according to claim 1, wherein a strain is imparted at an angle of 45° to 90° to the rolling direction of the steel sheet at intervals of 2 to 15 mm, a recess depth of 1 to 25 μm and a recess width of 500 μm or less after cold rolling to effect the division of magnetic-domain.

9. The process for producing a grain oriented electrical steel sheet having a high magnetic flux density and an excellent iron loss property according to claim 4, wherein said annealing separator contains as an additive a sulfate in an amount of 1 to 15 parts by weight in terms of total amount of ($SO_4$).

* * * * *

UNITED STATES PATENT AND TRADEMARK OFFICE

CERTIFICATE OF CORRECTION

PATENT NO. : 5,507,883
DATED : April 16, 1996
INVENTOR(S) : Tanaka, et al

Figure 2A:
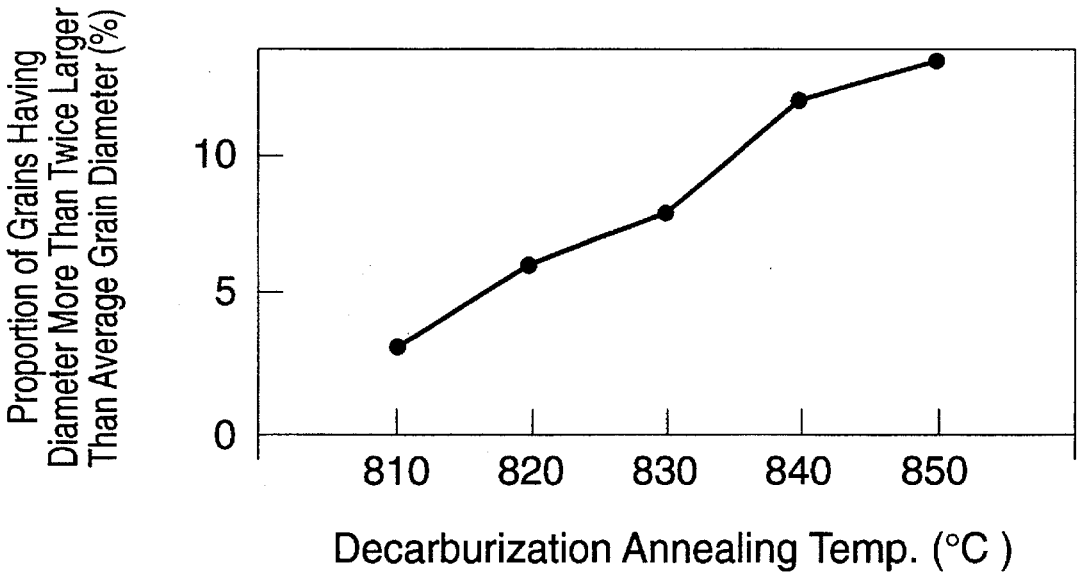
FIG. 2A is a graph showing the proportion in percent of primary grains having a diameter more than twice larger than the average grain diameter vs. the decarburization annealing temperature in ° C.
Figure 2B:
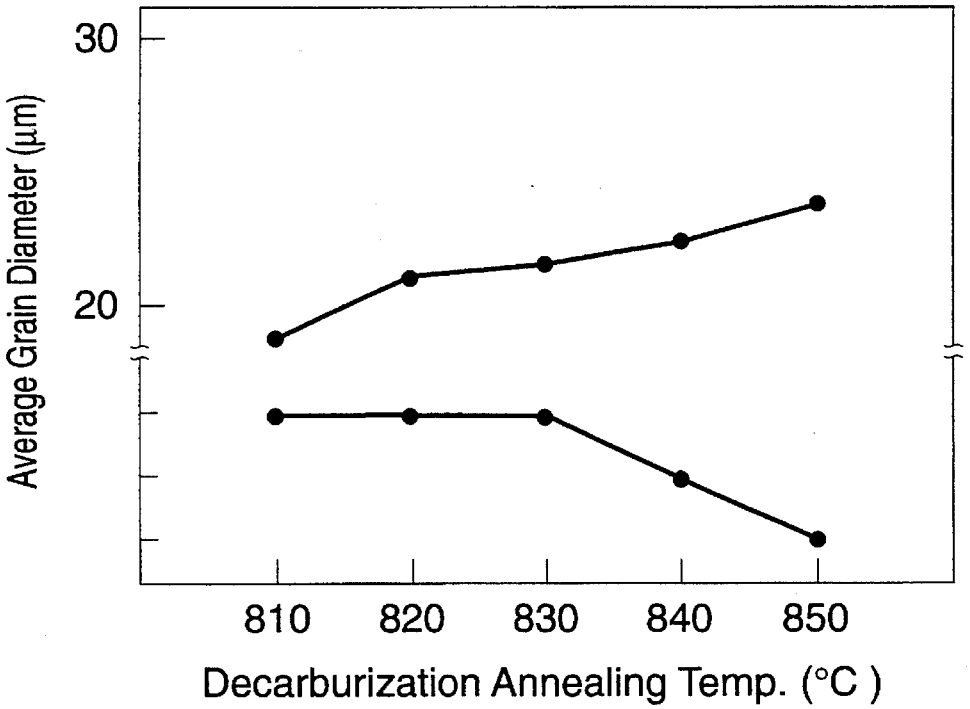
FIG. 2B is a graph showing the average diameter in μm vs. the decarburization annealing temperature in ° C.
Figure 2A:
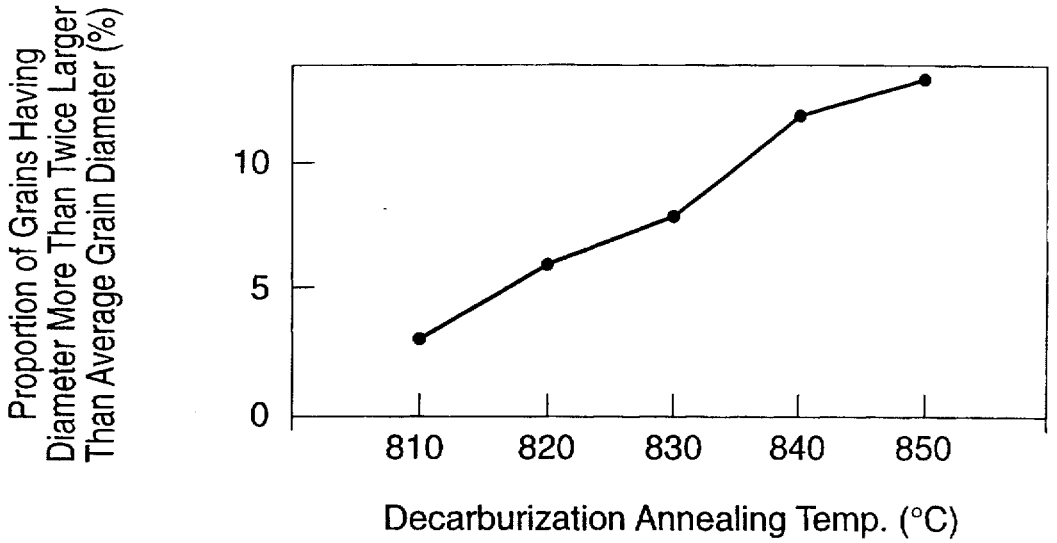
Figure 2B:
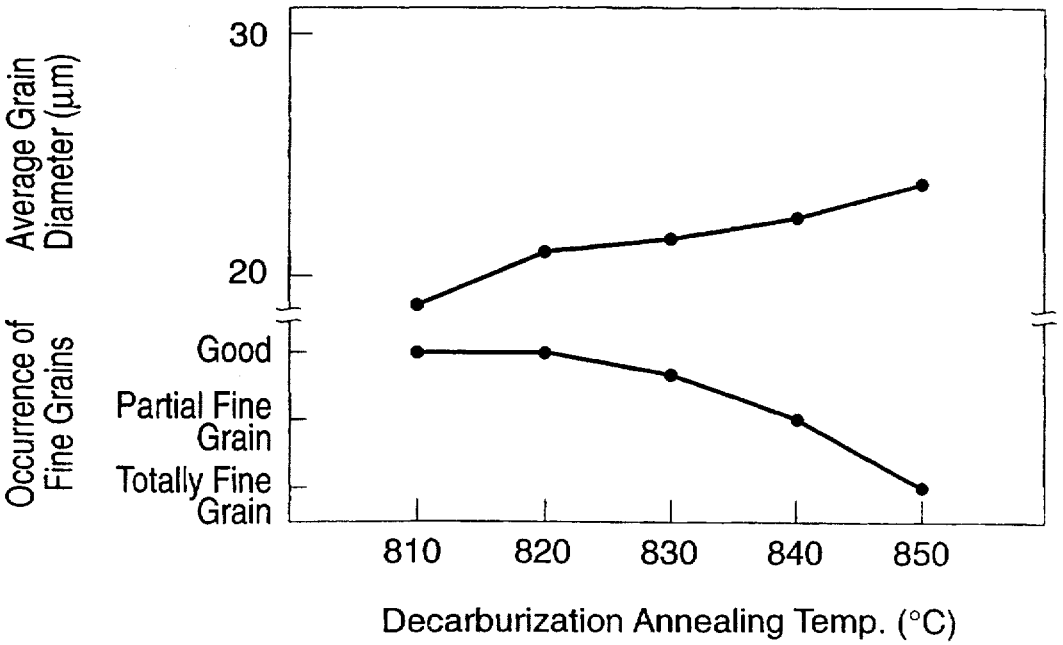

It is certified that error appears in the above-identified patent and that said Letters Patent is hereby corrected as shown below:

Delete Drawing Sheet 2 of 2, and substitute therefor the Drawing Sheet, consisting of FIGS. 2A–2B, as shown on the attached page.

Signed and Sealed this

Sixth Day of April, 1999

*Attest:*

Q. TODD DICKINSON

*Attesting Officer*

*Acting Commissioner of Patents and Trademarks*